US005150802A

United States Patent [19]

Jeffers

[11] Patent Number: 5,150,802

[45] Date of Patent: Sep. 29, 1992

[54] PUNCTURE AND SEAL CAP APPARATUS

[76] Inventor: Christopher M. Jeffers, 1548 Quinif St., Walled Lake, Mich. 48390

[21] Appl. No.: 790,829

[22] Filed: Nov. 12, 1991

[51] Int. Cl.[5] ..... B65D 51/22; B67B 7/50

[52] U.S. Cl. ..... 215/235; 215/234; 215/236; 215/258; 220/258; 220/277; 222/81

[58] Field of Search ..... 215/235, 231, 234, 236, 215/244, 257, 247, 258, 298, 354; 220/258, 259, 277, 278; 222/81, 89, 546, 556

[56] References Cited

U.S. PATENT DOCUMENTS

| | | | |
|---|---|---|---|
| 1,482,724 | 2/1924 | Baron | 215/235 |
| 1,489,297 | 4/1924 | Zulka | 215/244 |
| 1,878,956 | 9/1932 | Manteufel | 220/278 |
| 3,109,562 | 11/1963 | Ferris | 220/278 X |
| 3,163,331 | 12/1964 | Wallberg | 222/556 X |
| 3,282,478 | 11/1966 | Russell | 222/546 X |
| 3,503,544 | 3/1970 | Setera | 222/556 |
| 4,234,103 | 11/1980 | Strobl, Jr. et al. | 222/89 X |
| 4,678,098 | 7/1987 | Oka | 220/289 |
| 4,805,790 | 2/1989 | Leonetti et al. | 215/235 |
| 4,807,769 | 2/1989 | Gach | 215/235 |

*Primary Examiner*—Stephen Marcus
*Assistant Examiner*—Vanessa Caretto
*Attorney, Agent, or Firm*—Leon Gilden

[57] ABSTRACT

A cap apparatus includes a cylindrical cap body hingedly mounting a lid thereto, wherein the lid includes a rigid lid arm projecting exteriorly of the lid, including an "L" shaped spring leg arranged to maintain the lid arm in an orthogonal orientation relative to a conduit bore directed through the cap body. A conical piercing cone is mounted to a bottom surface of the lid projecting interiorly of the conduit bore to effect piercing of a seal member of an associated container, wherein the cap body includes a plurality of spring clips arranged to secure the cap body relative to the associated container. A modification of the invention includes the cap member apparatus defined as spaced flanges utilizing a piercing cone coaxially aligned with a presser plate to effect the clamping and piercing of a fluid container therebetween.

5 Claims, 4 Drawing Sheets

PUNCTURE AND SEAL CAP APPARATUS

BACKGROUND OF THE INVENTION

1. Field of the Invention

The field of invention relates to container apparatus, and more particularly pertains to a new and improved puncture and seal cap apparatus wherein the same is arranged for securement relative to an associated container to effect selective pouring of fluid from the container.

2. Description of the Prior Art

Container apparatus of various types, and particularly those utilized in the dispensing of engine fluid such as oil and the like, are frequently formed with a seal mounted within the container to prevent inadvertent spillage from the container during transport and storage thereof. Prior art structure exemplifying this organization is illustrated in U.S. Pat. No. 4,863,047 to Crow wherein a container includes a cap member removable to expose the film, wherein the film includes an associated arm to effect removal of the seal relative to the container.

U.S. Pat. No. 4,953,706 to Piccard sets forth an oil can seal breaker wherein pivoted arm structure mounted within the container is deflected to effect puncturing of the seal directed through the pouring spout of the container.

U.S. Pat. No. 3,730,336 to Feldman illustrates a rod member mounted within a container that is arranged for deflection to effect puncturing of the associated container.

U.S. Pat. No. 4,746,023 to Belter sets forth a puncturable oil seal wherein the same includes a puncturable membrane of a generally circular section preventing subsequent pouring of the fluid from the container.

U.S. Pat. No. 4,103,772 to Wigner sets forth a container with a frangible partition, wherein the partition includes an overlying puncture rod that is deflectable relative to the partition to effect puncturing of the partition.

As such, it may be appreciated that there continues to be a need for a new and improved puncture and seal cap apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of cap apparatus now present in the prior art, the present invention provides a puncture and seal cap apparatus wherein the same includes a cap member securable to an associated container utilizing a puncture structure to effect puncturing of a seal relative to the container. As such, the general purpose of the present invention, which will be described subsequently in greater detail, is to provide a new and improved puncture and seal cap apparatus which has all the advantages of the prior art cap apparatus and none of the disadvantages.

To attain this, the present invention provides a cap apparatus including a cylindrical cap body hingedly mounting a lid thereto, wherein the lid includes a rigid lid arm projecting exteriorly of the lid, including an "L" shaped spring leg arranged to maintain the lid arm in an orthogonal oreintation relative to a conduit bore directed through the cap body. A conical piercing cone is mounted to a bottom surface of the lid projecting interiorly of the conduit bore to effect piercing of a seal member of an associated container, wherein the cap body includes a plurality of spring clips arranged to secure the cap body relative to the associated container. A modification of the invention includes the cap member apparatus defined as spaced flanges utilizing a piercing cone coaxially aligned with a presser plate to effect the clamping and piercing of a fluid container therebetween.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved puncture and seal cap apparatus which has all the advantages of the prior art cap apparatus and none of the disadvantages.

It is another object of the present invention to provide a new and improved puncture and seal cap apparatus which may be easily and efficiently manufactured and marketed.

It is a further object of the present invention to provide a new and improved puncture and seal cap apparatus which is of a durable and reliable construction.

An even further object of the present invention is to provide a new and improved puncture and seal cap apparatus which is susceptible of a low cost of manufacture with regard to both materials and labor, and which accordingly is then susceptible of low prices of sale to the consuming public, thereby making such puncture and seal cap apparatus economically available to the buying public.

Still yet another object of the present invention is to provide a new and improved puncture and seal cap apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
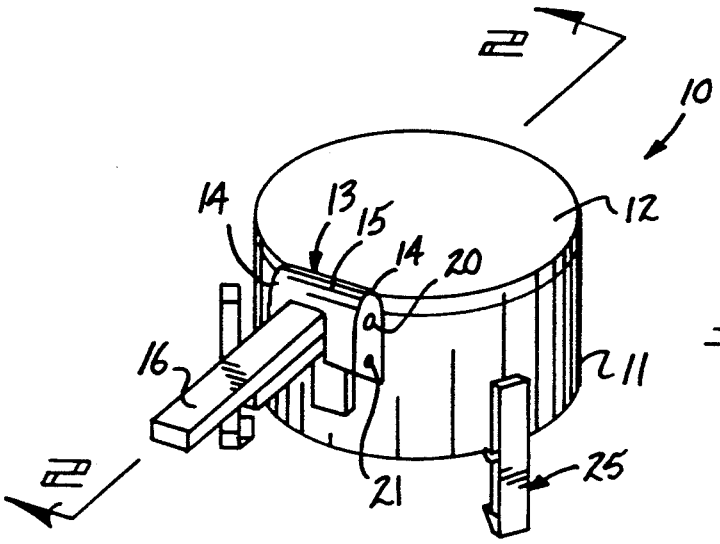
FIG. 1 is an isometric illustration of the instant invention.
Figure 2:
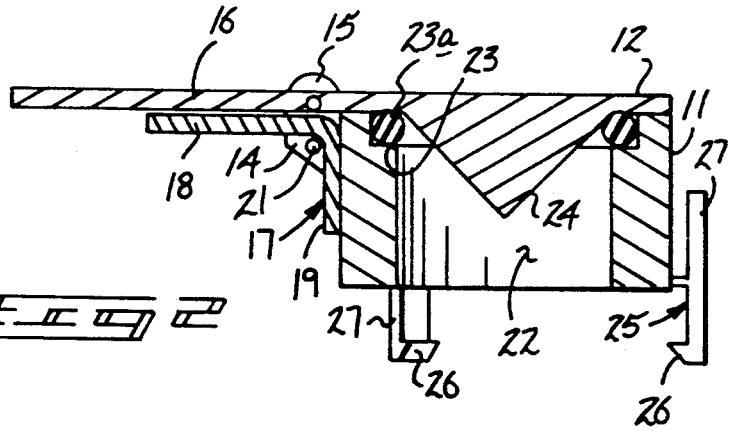
FIG. 2 is an orthographic view, taken along the lines 2—2 of FIG. 1 in the direction indicated by the arrows.
Figure 3:
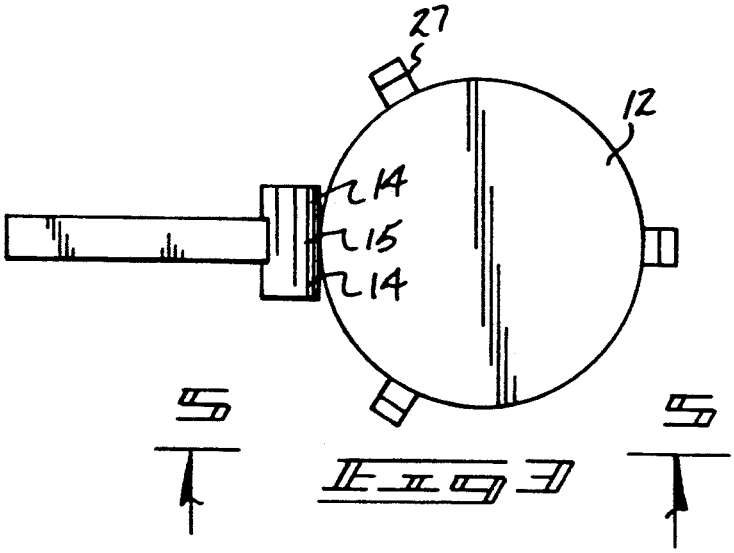
FIG. 3 is an orthographic top view of the instant invention.
Figure 4:
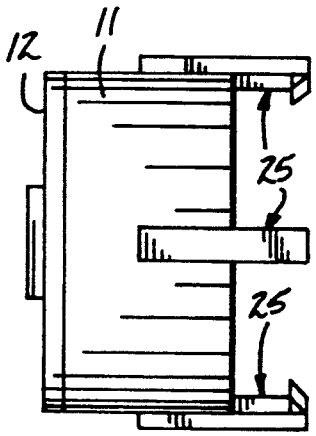
FIG. 4 is an orthographic side view of the instant invention.
Figure 5:
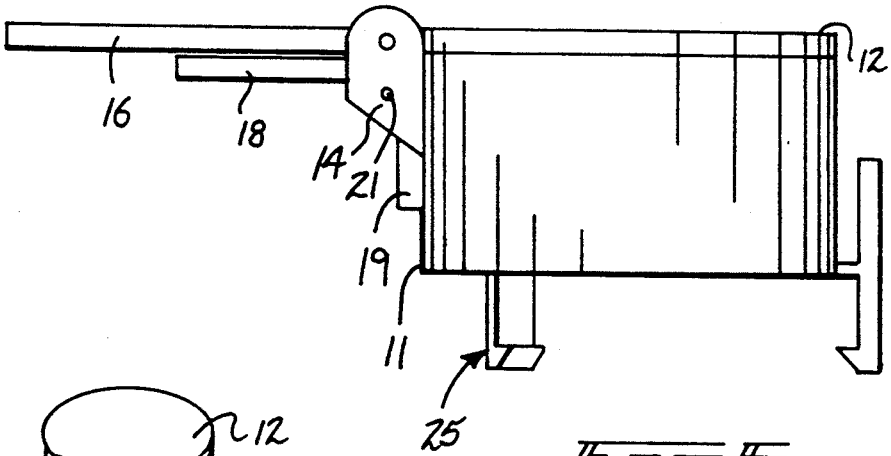
FIG. 5 is an orthographic view, taken along the lines 5—5 of FIG. 3 in the direction indicated by the arrows.
Figure 6:
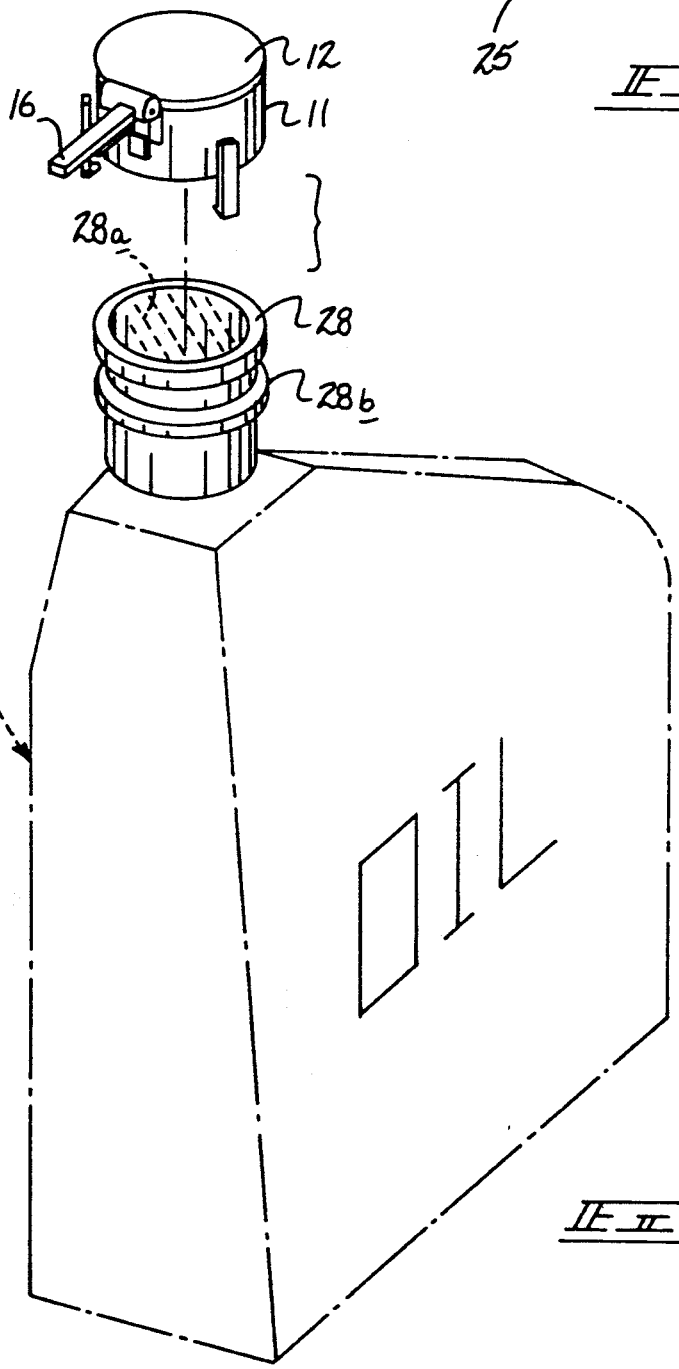
FIG. 6 is an isometric illustration of the invention mounted to an associated container.

With reference now to the drawings, and in particular to FIGS. 1 to 9 thereof, a new and improved puncture and seal cap apparatus embodying the principles and concepts of the present invention and generally designated by the reference numerals 10 and **10*a*** will be described.

More specifically, the puncture and seal cap apparatus 10 of the instant invention essentially comprises a cylindrical cap body 11, including a cap lid 12 hingedly mounted to the cap body about a hinge 13 formed to the cap body 11 at an upper terminal end thereof. The hinge 13 includes spaced parallel flanges 14 mounted to an exterior surface of the cap body 11 adjacent its upper terminal end rotatably receiving a central hinge barrel 15 between the flanges 14. The hinge barrel 15 is fixedly mounted to a top surface of a rigid lid arm fixedly mounted to the lid 12 diametrically aligned therewith extending exteriorly of the lid 12, with an "L" shaped spring leg 17 positioned in contiguous communication to a bottom surface of the lid arm 16 and to an exterior surface of the cap body 11. The "L" shaped spring leg 17 includes a horizontal spring leg portion 18 in communication with the bottom surface of the lid arm 16 and a vertical spring leg 19 mounted to the exterior surface of the cylindrical cap body 11. A pivot axle 20 is orthogonally directed through the flanges 14 and longitudinally through the barrel 15 to rotatably mount the barrel to the flanges, with an alignment pin 21 arranged parallel and below the pivot axle 20 directed in communication with the spring leg 17 at an intersection of the horizontal and vertical spring leg portions 18 and 19 to position the spring leg 17 relative to the flanges 14, with the alignment pin 21 directed through the flanges 14 as noted in a spaced parallel relationship relative to the pivot axle 20.

The cap body 11 includes a cap body internal conduit bore 22 coaxially directed through the cap body 11 defined by a first diameter, with a cap body shoulder 23 in communication with the upper terminal end of the cap body 11 defined by a second diameter greater than the first diameter mounting a shoulder seal ring **23*a* on the shoulder 23, wherein the ring 23*a* formed of a resilient material projects into the bore 22 from the shoulder 23. A lid piercing cone 24 is fixedly mounted to a bottom surface of the lid 12 coaxially aligned with the bore 22 projecting into the bore 22 below the shoulder 23 to effect piercing of a container spout sealing web 28*a* (see FIG. 6) when the cap apparatus is mounted to a container spout 28 of an associated container 29. To enhance securement of the cap body 11 to the spout 28, a spout annular flange 28*b* is mounted exteriorly of the spout below its upper terminal end for mechanical interlocking with a plurality of spring clips 25 equally spaced about the exterior surface of the cylindrical cap body 11 projecting below at a lower terminal end thereof. The spring clips 25 each include a leg member 27 mounted to the exterior surface of the body 11, and each leg member includes a locking flange 26 orthogonally oriented relative to a lower terminal end of each leg member 27 to project below a bottom edge portion of the annular flange 28*b* to simultaneously secure the cap structure to the spout 28 and simultaneously puncture the seal 28*a***.

Figure 7:
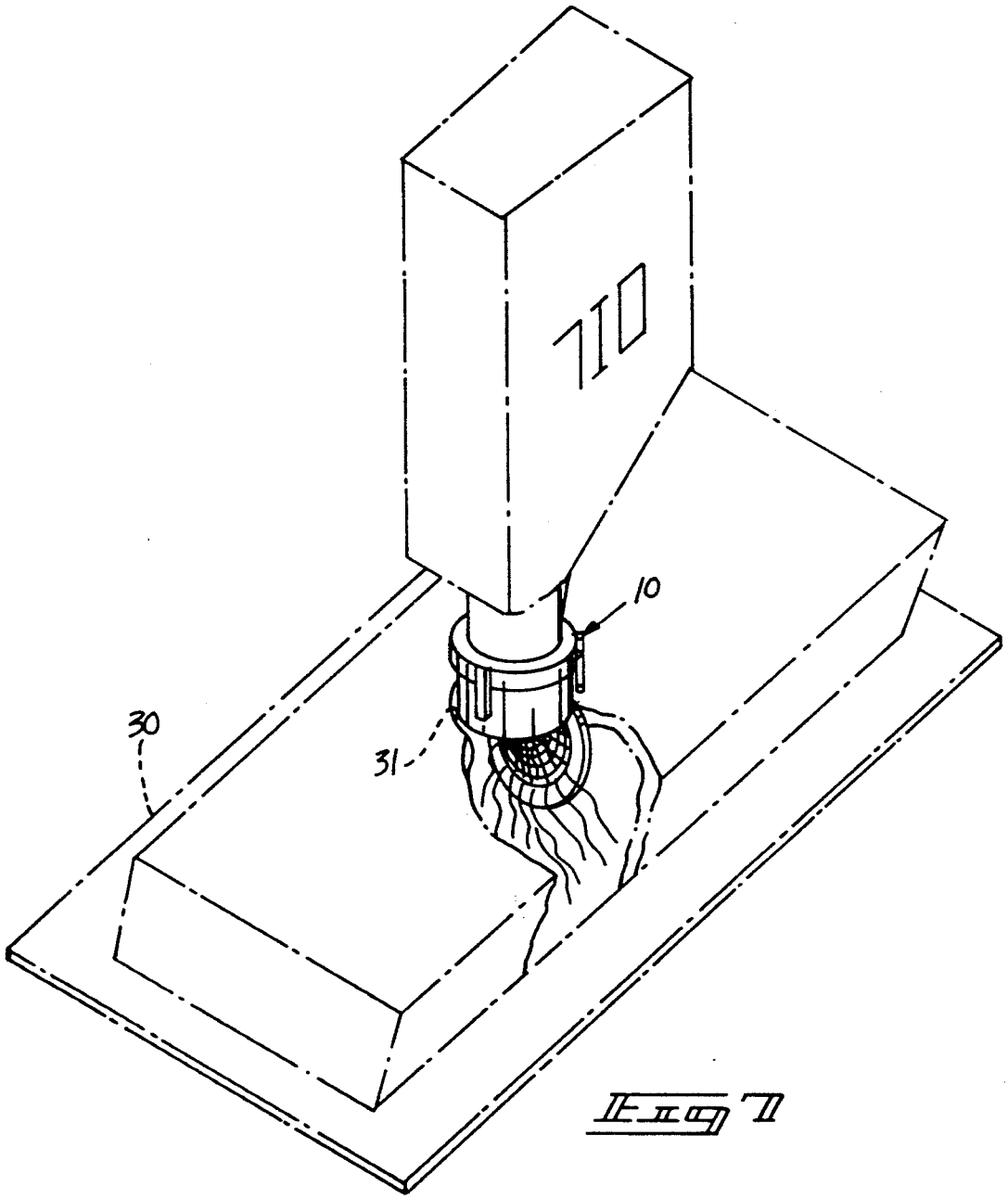
FIG. 7 is an isometric illustration of the invention in use.

In use, when thusly assembly, the cap apparatus 10 is arranged for positioning within a valve cover opening 31 of an associated internal combustion valve cover 30, as illustrated in FIG. 7.

Figure 8:
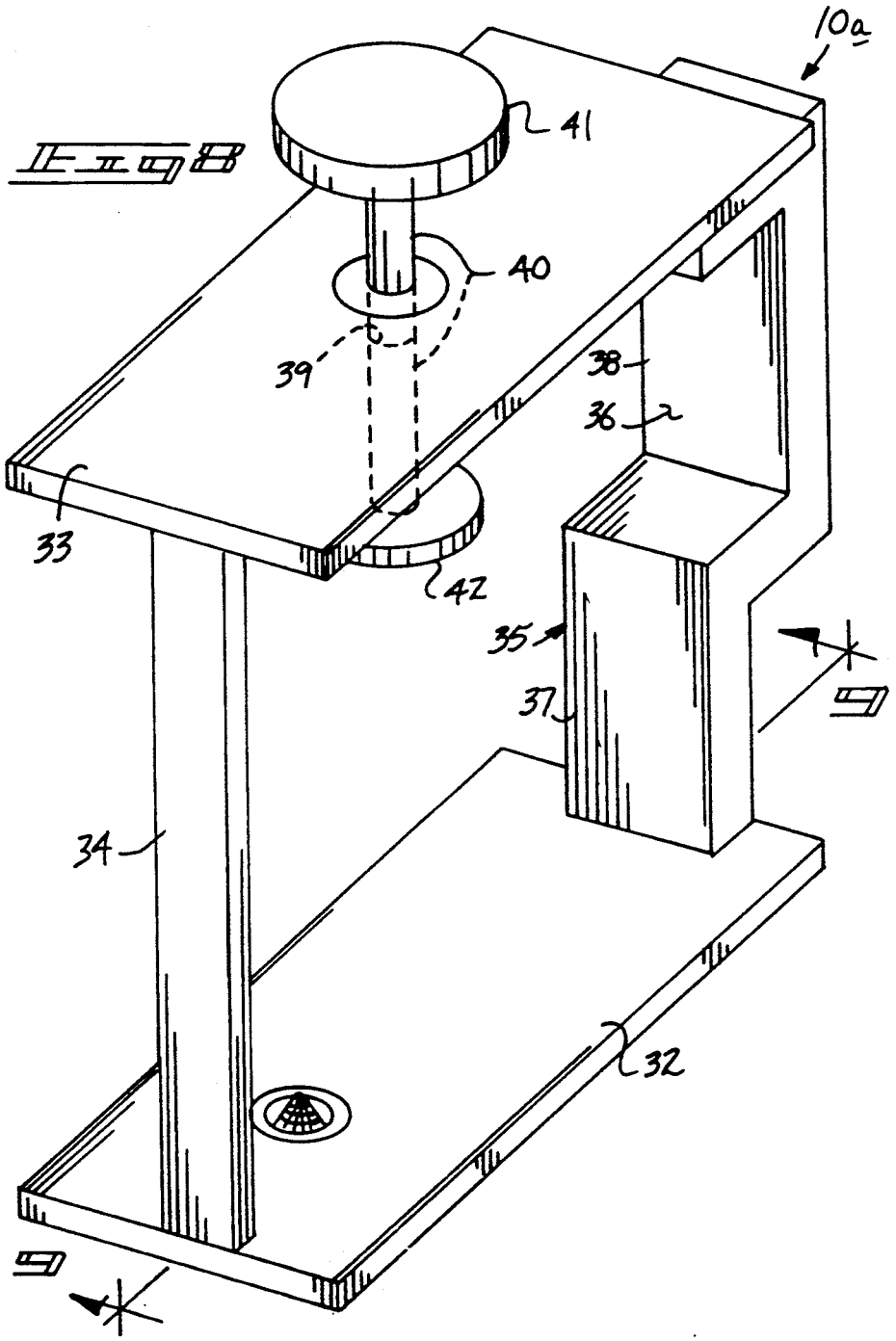
FIG. 8 is an isometric illustration of a modification of the invention.
Figure 9:
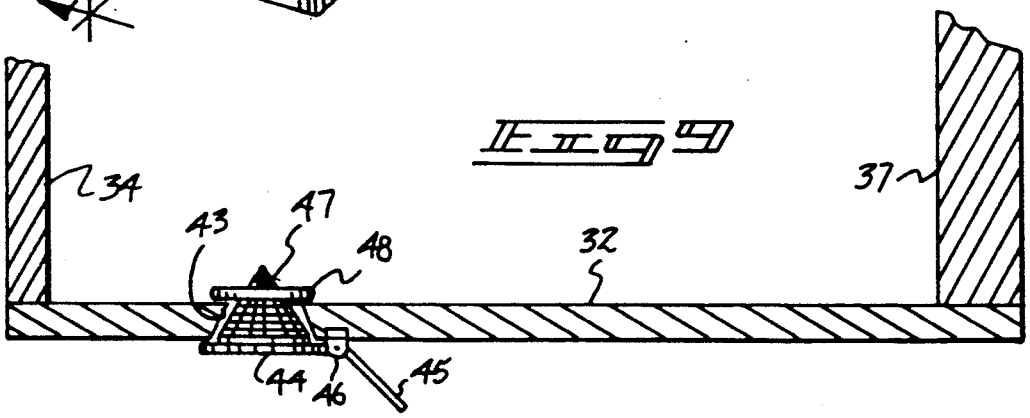
FIG. 9 is an orthographic view, taken along the lines 9—9 of FIG. 8 in the direction indicated by the arrows.

The FIGS. 8 and 9 illustrate a modified apparatus **10*a*, wherein a first plate 32 is spaced from and parallel a second plate 33. A first connecting flange 34 orthogonally oriented between the first and second plates 32 and 33 is integrally mounted to the first and second plates at aligned first edges of the first and second plates, wherein the aligned second edges of the first and second plates include a second connection flange 35 orthogonally oriented between the first and second plates. The second flange 35 includes a second flange recess 36 defined by a second flange first leg 37 fixedly mounted to the first plate 32, with a second flange second leg 38 spaced outwardly of the second flange first leg 37 in a spaced parallel relationship to define a handle by the recess 36 to permit manual grasping of the apparatus 10*a*. The apparatus 10*a* is arranged to receive and pierce a container to be received within the first and second plates 32 and 33. The second plate 33 includes a second plate threaded bore 39 threadedly receiving a threaded rod 40 therethrough. The threaded rod 40 includes a handle 41 fixedly mounted at an upper terminal end of the threaded rod 40 spaced above the second plate 33, with a second plate presser plate 42 positioned below the second plate between the second plate and the first plate, with the presser plate 42 orthogonally oriented relative to a lower terminal end of the rod 40. A first plate bore 43 is coaxially aligned with the rod 40, and includes a bore lid 44 hingedly mounted to the first plate, with the lid 44 including a lid handle 45 projecting exteriorly of the lid 44, with a spring hinge 46 hingedly biasing the lid 44 into a closed overlying relationship relative to the bore 43. The lid 44 is positioned exteriorly of the first plate 32, with a piercing cone 47 mounted to a bottom surface of the lid 44 extending into and above an interior surface of the first plate 32 to effect piercing of a can positioned between the presser plate 42 and the piercing cone 47. Accordingly, the piercing cone 47 is coaxially aligned with the rod 40. A piercing cone seal 48 mounted to the interior surface of the first plate 32 in surrounding relationship relative to the bore 43 is coaxially aligned with the bore 43 and the rod 40, with the seal 48 in confronting relationship relative to the presser plate 42 to effect sealing of a container positioned between the interior surface of the plate 32 and the presser plate 42. To release fluid from the associated container positioned between the presser plate 42 and the interior surface of the first plate 32, the handle 45 is merely pivoted about the spring hinge 46 to effect release of fluid through the bore 43**.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A puncture and seal cap apparatus for securement to a container, wherein the apparatus includes a cylindrical cap body, the cap body including a body upper terminal end and a body lower terminal end, the cap body including a conduit bore coaxially directed coextensively through the cap body, and a lid hingedly mounted to the cap body at the upper terminal end, the lid and the cap body including a hinge to pivotally mount the lid to the cap body, and the lid including a lid piercing cone fixedly and integrally mounted to an interior surface of the lid, wherein the piercing cone is coaxially aligned with the bore in a first position when the lid is in a contiguous communication with the cap body upper terminal end, and the container including a container spout, wherein the container spout includes a sealing web mounted to the spout at an upper terminal spout end, and the spout including an annular flange, and the cap body including a plurality of spring legs for securement of the cap body to the flange.

2. An apparatus as set forth in claim 1 wherein each spring leg includes a first leg member fixedly mounted to a cap body exterior surface, and each leg member includes a locking flange fixedly and orthogonally mounted to a lower terminal end of each leg member, and the bore is defined about a central bore axis, and each locking flange is orthogonally oriented relative to the bore axis, and each locking flange projects below the cap body lower terminal end.

3. An apparatus as set forth in claim 2 wherein the bore includes a shoulder bore positioned adjacent the cap body upper terminal end, wherein the shoulder bore is defined by a second diameter, and the bore is defined by a first diameter and the second diameter is greater than the first diameter, and a shoulder seal ring mounted within the shoulder bore projecting beyond the shoulder bore into the bore and in contiguous communication with the lid in the first position.

4. An apparatus as set forth in claim 3 wherein the lid includes a rigid lid arm fixedly mounted to and extending diametrically exteriorly of the lid and diametrically aligned with the lid, and an "L" shaped spring leg, the "L" shaped spring leg including a horizontal spring leg, and the horizontal spring leg fixedly mounted to a bottom surface of the lid arm, and the "L" shaped spring leg including a vertical spring leg, the vertical spring leg orthogonally oriented relative to the horizontal spring leg and the vertical spring leg fixedly mounted to the cap body exterior surface, and the hinge including a plurality of spaced parallel flanges, the flanges mounted to the cap body exterior surface, and the lid arm including a central hinge barrel fixedly mounted to a top surface of the lid arm positioned between the parallel flanges, and a pivot axle directed orthogonally through the flanges and through the central hinge barrel to permit rotation of the central hinge barrel relative to the flanges, and wherein the "L" shaped spring leg maintains the rigid lid arm and the cap lid in the first position.

5. An apparatus as set forth in claim 4 including an alignment pin, the alignment pin orthogonally directed through the spaced parallel flanges below and parallel the pivot axle, the alignment pin in contiguous communication with an intersection of the horizontal spring leg and the vertical spring leg to maintain the "L" shaped spring leg in operative communication with the lid arm.

* * * * *